US006145265A

United States Patent [19]

Malarkey et al.

[11] Patent Number: 6,145,265

[45] Date of Patent: Nov. 14, 2000

[54] LAMINATED SHINGLE

[75] Inventors: Gregory Malarkey; William Allinger, both of Portland, Oreg.

[73] Assignee: Herbert Malarkey Roofing Company, Portland, Oreg.

[21] Appl. No.: 09/251,534

[22] Filed: Feb. 17, 1999

[51] Int. Cl.[7] ..... E04D 1/28

[52] U.S. Cl. ..... 52/555; 52/557; 52/559; 52/560; 52/745.19

[58] Field of Search ..... 52/555, 557, 559, 52/560, 745.19

[56] References Cited

U.S. PATENT DOCUMENTS

| | | |
|---|---|---|
| 1,767,374 | 6/1930 | Kirschbraun . |
| 1,829,886 | 11/1931 | Yates et al. . |
| 3,180,783 | 4/1965 | Walker et al. . |
| 3,921,358 | 11/1975 | Bettoli . |
| 4,198,257 | 4/1980 | Pfaff . |
| 4,233,100 | 11/1980 | Cunningham et al. . |
| 4,717,614 | 1/1988 | Bondoc et al. . |
| 4,729,814 | 3/1988 | Jennus et al. . |
| 4,775,440 | 10/1988 | Jennus et al. . |
| 4,795,661 | 1/1989 | Bondoc et al. . |
| 4,869,942 | 9/1989 | Jennus et al. . |
| 5,052,162 | 10/1991 | Bush et al. . |
| 5,186,980 | 2/1993 | Koschitzky . |
| 5,347,785 | 9/1994 | Terrenzio et al. . |

*Primary Examiner*—Christopher T. Kent
*Attorney, Agent, or Firm*—Ipsolon LLP

[57] ABSTRACT

Laminated shingles are manufactured from roll stock roofing material that is wider than that used to make similar laminated shingles. The roll stock includes longitudinal edge strips having a reduced thickness. The roll stock is cut into strips of tabbed top sheets and backing sheets. The strips of material used for the backing sheets are at once wider than commonly used in the industry, and include the longitudinal edge strips of reduced-thickness material. Because the backing sheet is wider two rain seal strips are laid down on the backing sheet prior to being laminated to the tabbed top sheet. The backing sheets are laminated to the tabbed top sheets with the longitudinal edges aligned. The wider backing sheet provides a substantially wider nail zone. In addition, since it allows for a second rain seal strip, provides somewhat more protection against leakage. The portion of the backing sheet that comprises the added width is relatively thinner than the remaining portions of the sheet. Paired shingles may therefore be oriented adjacent one another in opposite directions and stacked and bundled. The total thickness of the stack will be the same throughout the stack, so the stack of shingles is flat.

25 Claims, 5 Drawing Sheets

LAMINATED SHINGLE

FIELD OF THE INVENTION

This invention relates to roofing shingles, and more specifically to laminated roofing shingles and a method for producing such shingles.

BACKGROUND AND SUMMARY OF THE INVENTION

Laminated roofing shingles, which are also sometimes called architectural shingles, have become widely used in the roofing industry. These shingles provide many advantages over other types of roofing materials, but the primary advantage and attraction with these products is the attractive appearance they provide when applied to a structure.

There are many styles, types and manufacturers of laminated shingles. Like most all shingles, laminated shingles have a length dimension and a width dimension, and these dimensions are somewhat standard in the industry. In general, laminated shingles are characterized in their having two or more layers of asphaltic roofing material overlaid upon one another and bonded together to provide a shingle having thicker sections. The upper layer of the shingle has alternating "tabs" and cutout portions in the lowermost edge of the shingle—that is, the edge of the shingle that is found on the downhill side of the shingle when the shingle is applied to a sloped roof. The lower layer underlies at least the tabbed portion of the upper layer.

The length dimension of the two sheets of a laminated shingle is typically the same. However, the width dimension generally is not. Nonetheless, it is possible to manufacture a laminated shingle having a lower layer and an upper layer having the same peripheral dimensions, and some manufacturers do make such shingles.

The most common kind of laminated shingle has a lower layer called a backing sheet and an upper layer laminated to the backing sheet. As noted, the upper layer has tabs cut into the lower edge. The two sheets are not coextensive in the width dimension; the backing sheet is not as wide as the upper layer. Instead, the backing sheet extends only partially up the width of the upper layer, and generally extends only a short distance past the extent of the tabs that are cut into the upper layer.

When laminated shingles are applied to a roof, nails or other fasteners must be applied to through two layers of shingle material. The nails must be applied above the headlap margin—that area above the upper margin of the cutout portions of the top sheet—and below the upper margin of the backing sheet. Nails thus may be placed in a zone that extends along the length of the shingle, the so-called "nail zone."

Nail application through a double layer of asphaltic material (i.e., in the nail zone) is essential to proper installation of laminated shingles, and is required by most shingle manufacturers. In addition, many local building codes refer to manufacturers recommended installation instructions for guidance on proper roof installation. There are good reasons for this requirement. First, nailing through a double layer of material provides strength, which is essential for roofing integrity in windy conditions. Second, if a laminated shingle is applied with nails placed through just the upper layer of the shingle, above the nail zone, it is possible for the backing sheet to slip out from under the upper layer. This may happen, for instance, on a roof having a steep slope during hot weather when the compounds used to bond the layers of the laminates together—typically an asphaltic compound—become flowable. This obviously causes severe damage to a roof.

One of the critical issues, therefore, in designing a laminated shingle is to provide a nail zone that facilitates consistent nail application in the proper location. Another somewhat diametrical consideration taken into account when designing laminated shingles is packaging the shingles for shipping and storage. Shingles are typically bundled in stacks with an overwrapping material. Since the two sheets in most laminated shingles are not coextensive in the width dimension, stacking the shingles in the same orientation above one another would result in a stack and bundle that is not flat. That is, some portions of the stack would have more layers of sheet material than others, so the entire stack would not be flat and instead would have a bow in it. This is unacceptable, since many bundles of shingles must be loaded onto, for instance, pallets for shipping. If the bundles are not flat, they cannot be stacked on a pallet with good stacking integrity.

A standard solution to this problem is to first build the laminated shingle such that the backing sheet extends no more than ½ of the distance of the top sheet in the width dimension. Then, two of this kind of shingle may be paired with one another such that they are oriented in opposite directions. This results in a pair of laminated shingles oriented in opposite directions with respect to one another, and which will lie flat when stacked since each pair of shingles will have three layers of shingle at all points in the stack. Multiple pairs of shingles oriented in this fashion may then be bundled into flat bundles, which are well suited for shipping and storage.

There are several variations on this basic stacking theme with laminated shingles that have a backing sheet that is no more than ½ the width of the top sheet. However, this solution leads to several problems. Most notably, such shingles have a nail zone that is relatively narrow. Thus, the width of the nail zone is constrained by two factors. First, the nail zone must be far enough beyond the limits of the tabs on the upper layer to insure that the nails are well-removed from exposure to the weather and are covered by the next overlying course of shingles. Second, the nails must be applied through a double layer of material—thus, through the nail zone.

The problems with laminated shingles having narrow nail zones are notorious in the industry. Most laminated shingles are applied by roofers who use automatic nailing or stapling guns such as pneumatic guns. These workers typically want to apply the roofing as quickly as possible—there are obvious economic advantages in doing so since the roofer may be paid by how much roofing is applied. However, a narrow nail zone combined with high speed pneumatic nailing guns and a desire to apply shingles rapidly makes a recipe for trouble, and improper nail application has often been the result. In fact, it has been observed that the vast majority of roofs with laminated shingles have many, many improperly applied shingles, and perhaps over 50% of all laminated shingles include at least some nails driven through only one sheet. Most importantly, this compromises the integrity of the roofing. It also may violate code restrictions for proper application of the roofing materials. With a typical roof containing somewhere between 5,500 and 7,500 nails, there are many opportunities for misplaced nails when they are not carefully applied.

Despite these limitations with laminated shingles, the vast majority of these products are manufactured as noted above with a relatively narrow nail zone. There is a need therefore for a laminated shingle product that is aesthetically pleasing yet makes proper installation easier, that is, installation with the fasteners applied through two sheets, and which is readily stacked, bundled and shipped.

The laminated shingle of the present invention addresses these concerns in a different manner. The shingles start with asphaltic roll stock that is wider than traditional roll stock. The roll stock is then manufactured such that the outer marginal edges have a relatively thinner zone than the remainder of the material. This roll stock is then cut and formed into a laminated shingle in a standard manner. However, the nail zone is substantially wider than traditional laminated shingles because the wider roll stock allows for a wider backing sheet. This wider nail zone has two layers of asphaltic material through which the nails may be rapidly driven. Given the substantially increased width of the nail zone, the nails seldom miss their intended mark.

Stacking, bundling and shipping the laminated shingle of the present invention also is not a problem. While the backing sheet of the present laminated shingle is substantially greater than ½ of the width of the top sheet, which thus results in the wider nail zone, the wider portion of the backing sheet is relatively thinner than the remainder of the sheet. This therefore allows shingles to be paired with one another in a traditional manner, as described above, and stacked with multiple additional pairs of shingles, but produces a flat stack for bundling and shipping.

DETAILED DESCRIPTION OF PREFERRED EMBODIMENTS

Prior Art

Figure 1:
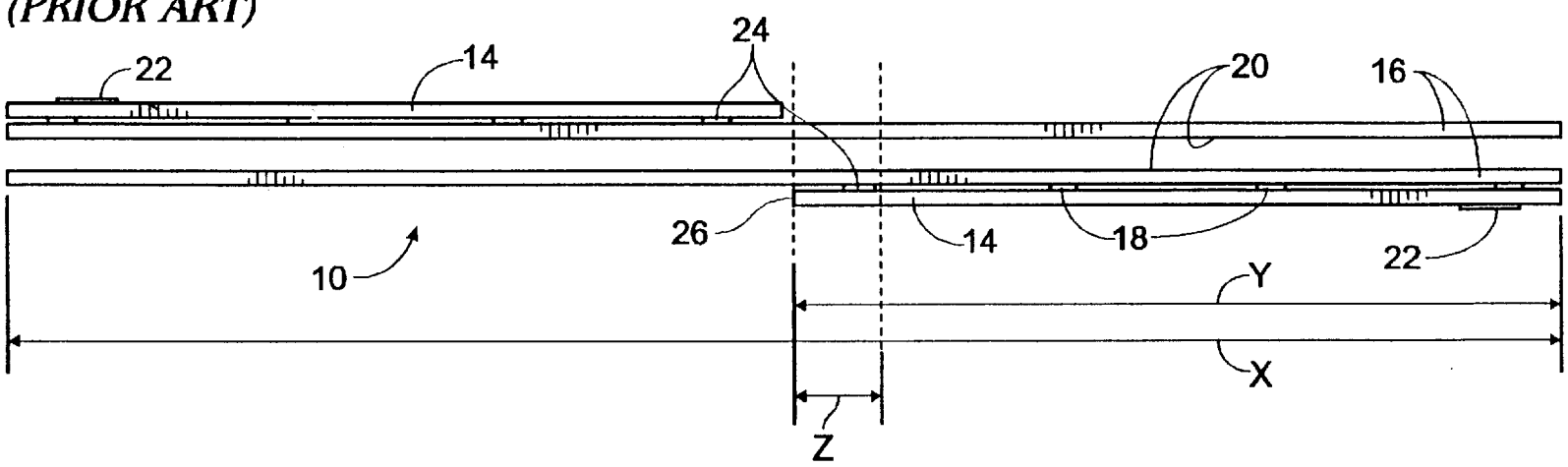
Fig. 1 (PRIOR ART)
FIG. 1 is a side edge elevational view of two paired, stacked prior art laminated shingles.
Figure 2:
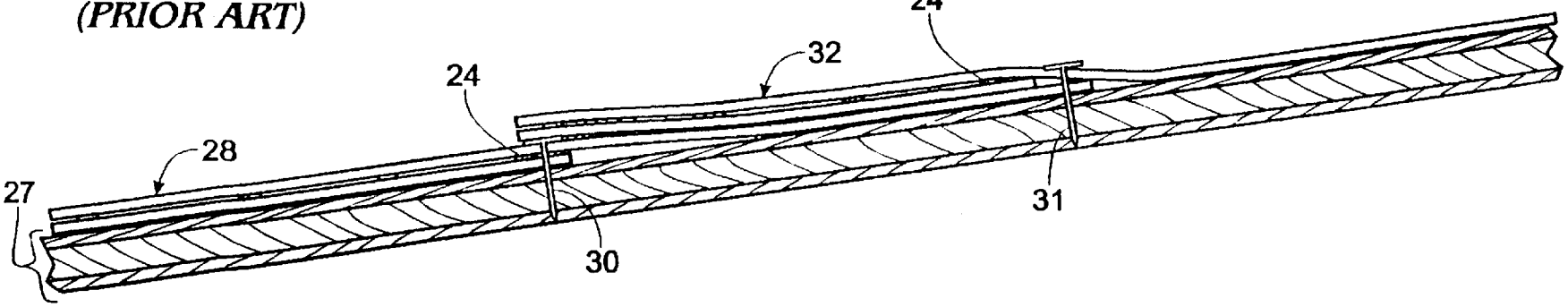
Fig. 2 (PRIOR ART)
FIG. 2 is a side edge elevational view of two prior art laminated shingles as they are applied to a roof deck, showing one correctly applied fastener and one incorrectly applied fastener.

FIGS. 1 and 2 illustrate two paired prior art laminated shingles. In FIG. 1 the two shingles 10 and 12 are shown stacked on top of one another, as they would be stacked in a bundle of shingles. A bundle of shingles contains many such paired shingles. However, for purposes of illustration only two shingles are shown. Each shingle comprises two layers of standard granule-coated asphaltic roofing material laminated together to form a double-layered shingle. Referring to shingle 10, the shingle includes a backing sheet 14 and an upper sheet 16 laminated on top of the backing sheet with an asphaltic adhesive 18 applied to selected areas between the two sheets. With the particular prior art shingles 10 and 12 shown in FIG. 1, the granule coated side of the roofing material, that is, the sides of the shingles exposed to the weather when the shingles are applied to the roof, are labeled 20. A seal down strip 22 is applied to the lower side of the shingle, that is, the side of the shingle that is not exposed to the weather when the shingle is applied to a roof. The seal down strip adheres to underlying shingles when installed to provide roof integrity. A single rain seal strip 24 is applied between the laminates and extends along the entire longitudinal length of the shingle.

Prior to laminating the two sheets, tabs are cut into one longitudinal edge of top sheet 16 resulting in alternating tabs and cutout portions. The tabs extend only partially into the sheet and terminate at a headlap margin just prior to the position of the rain seal strip 24 that as noted extends along the entire length of the sheet. When a second course of shingles is applied to a roof deck, the lower marginal edges of the shingles in the second course are preferentially aligned with the headlap margin.

The backing sheet in the prior art shingle shown in FIG. 1 is no greater than ½ the width of the top sheet. The width of the top sheet is represented by dimension X. The width of the backing sheet, dimension Y, is no more than ½ X. This particular structure allows the laminated shingles to be paired as shown in FIG. 1, where shingle 12 is inverted relative to shingle 10 and is rotated 180° about the axis perpendicular to the longitudinal axis of the shingle, and stacked with other like-paired shingles into a flat bundle. With the shingles shown in FIG. 1, if the backing sheet were any wider than ½ the width of the top sheet, the paired shingles when stacked would have overlapping zones that would have more layers than adjacent zones, leading to a bowed stack. This is unacceptable, as it results in stacking and shipping problems.

For the reasons noted above, laminated shingles must be nailed to the roof through an area of the shingle that has two layers. But in shingle 10, as a result of the backing sheet being no greater than ½ the width of the top sheet, the "nail zone" is relatively narrow. The nail zone is not in the same place on all shingles. The nail zone in the shingle shown in FIG. 1 is that portion of the laminated sheets that lies generally above the headlap margin and below the upper marginal edge 26 of backing sheet 14. The nail zone of shingle 10 is labeled with dimension Z. To prevent leaks, it is preferable that the nails be applied above the rain seal strip, or at least in the rain seal strip but below the uppermost marginal edge 26 of the backing sheet. Thus, if the nails are above the rain seal strip there is less chance that nails will be exposed to moisture. Further, the nail heads must not be exposed and instead must be covered by the next overlapping course of shingles.

This so-called nail zone in the prior art shingles is shown in FIG. 2. A shingle 28 in the first course of shingles is nailed to the roof deck 27 with a plurality of nails 30, only one of which is shown for the lowermost shingle 28. Nail 30 is shown correctly applied. The next adjacent shingle 32 in the next course of shingles is placed over shingle 28 in the first course and is nailed in place in a like manner. However, as may be seen, and to illustrate the problems associated with improperly applied fasteners, nail 31 is shown driven through only one layer of the shingle 32 and in a position such that the nail is driven through only one layer of the laminated sheets. Nail 31 is thus driven through the shingle outside of the nail zone. This results in the problems discussed above, and is a significant problem with current products. The improper nailing is a direct result of the relatively narrow nail zone. And the nail zone is necessarily relatively narrow in view of the need to make the backing sheet no greater than ½ the width of the top sheet, which as mentioned is a design feature that facilitates stacking and bundling. However, the closer the nails are placed to the lowermost edge of the nail zone, the greater the possibility that water will leak through the nail hole, or that there will be exposed nails on the roof. Furthermore, roof integrity is compromised since the backing sheet of shingle 32 may literally slip out from its attachment to the top sheet when the roof becomes hot and the adhesive material sloughs.

Preferred Embodiment

Figure 3:
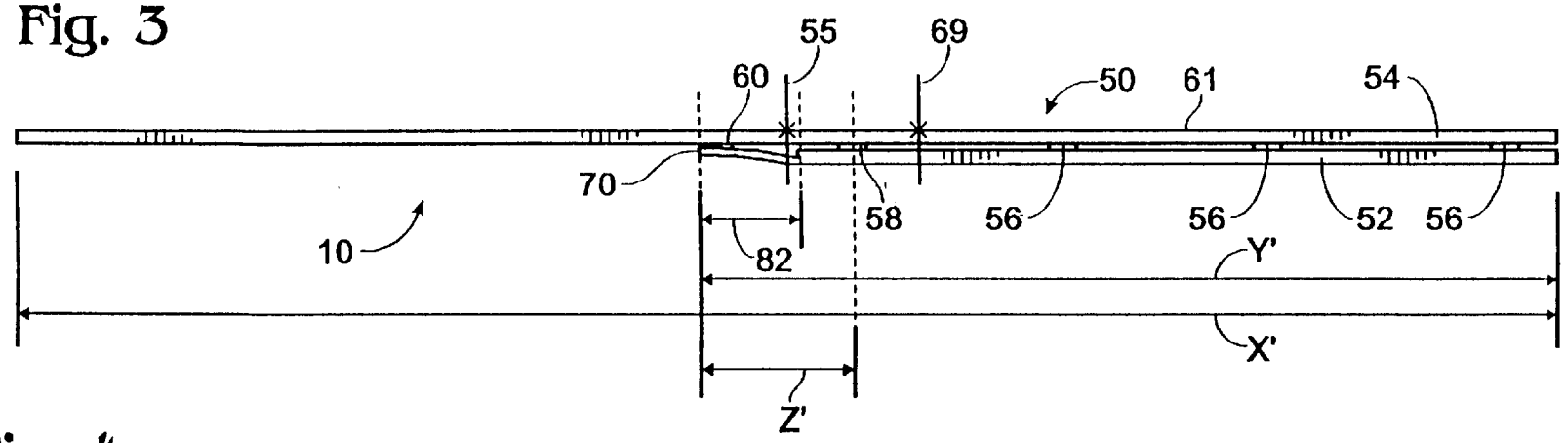
FIG. 3 is a side edge elevational view of the shingle of the present invention, taken along the line 3—3 of FIG. 4.

A preferred embodiment of a laminated shingle 50 of the present invention is shown in FIG. 3 and includes a backing sheet 52 and a top sheet 54, both comprising a granule coated asphaltic roofing material. The two sheets are laminated at selected locations, as described below, with an asphaltic adhesive 56. Shingle 50 has two rain seal strips 58 and 60. The weather-exposed side of shingle 50—that is, the granule coated side of the shingle—is labeled 61. The width dimension of the top sheet 54 is dimension X'. The width of backing sheet 52 is Y'. The center point of shingle 50 in the width dimension is labeled 55. In shingle 50 Y' is always greater than ½ X'.

Figure 4:
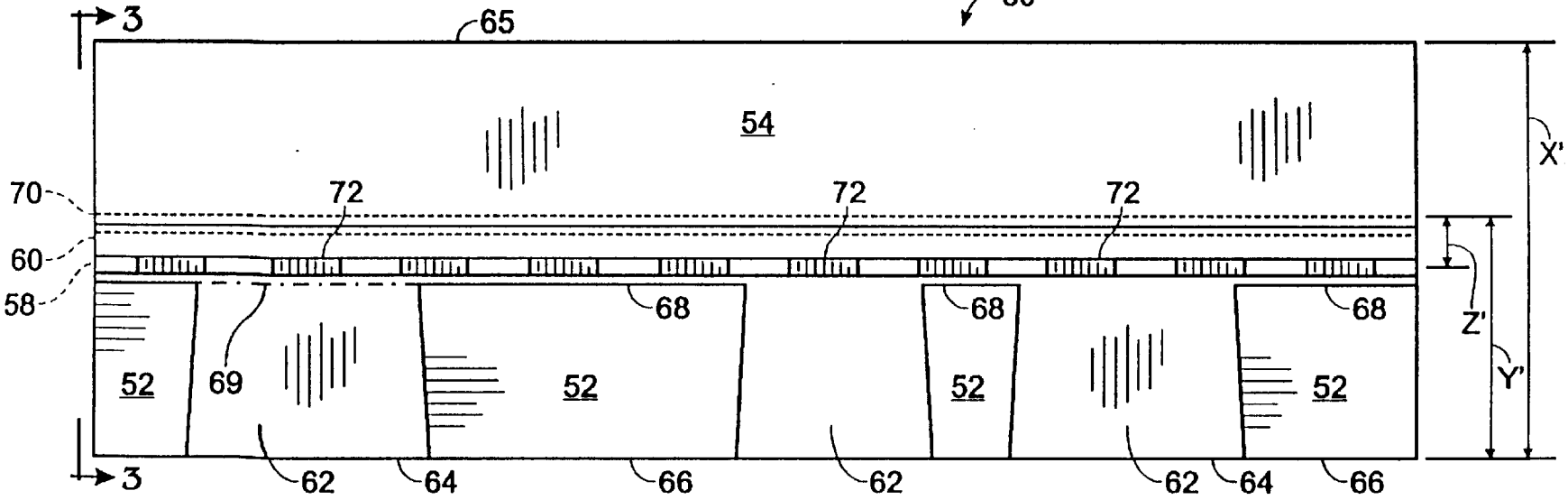
FIG. 4 is a top plan view of a laminated shingle according to the present invention.

Referring to FIG. 4, shingle 50 may be seen as having top sheet with width dimension X' and backing sheet with width dimension Y'. Prior to laminating the backing sheet and the top sheet, and as described below, tabbed sections are cutout of one marginal edge of the top sheet resulting in alternating tabs 62 and cutout portions being formed along the longitudinal edge 64 of the top sheet. The upper marginal edge 68 of the cutout portions of the top sheet define a headlap margin 69 (FIG. 3) extending longitudinally along the length of the shingle. When the a backing sheet and a top sheet are laminated together, longitudinal edge 64 of top sheet 54 is aligned with longitudinal edge 66 of backing sheet 52 such that the two marginal edges are coextensive or aligned. As used herein, upper refers to the direction toward longitudinal marginal edge 65 of top sheet 54, as that is the edge of the shingle that is situated higher than the opposite longitudinal edge 64 as the shingle sits on a sloped roof deck. This naming convention is followed throughout.

As noted, shingle 50 has two rain seal strips. The first rain seal strip 58 extends completely along the entire length of shingle 50 between backing sheet 52 and top sheet 54. The rain seal is an unbroken, continuous strip of asphaltic adhesive that is applied to the backing sheet prior to lamination of the two sheets. The purpose of the rain seal is to prevent water from blowing or wicking from the upper marginal edges 68 of the cut out portions of the top sheet and between the top sheet and the backing sheet when the shingle is applied to a roof, and also to adhere the backing sheet to the top sheet. As described below, nails are applied to the area above the first rain seal strip. As such, the first rain seal strip prevents water from reaching the nails. It also prevents water from wicking or blowing between the backing sheet and top sheet and over the upper marginal edge 70 of the backing sheet. The second rain seal strip 60 also extends completely along the length of shingle 50 between backing sheet 52 and top sheet 54. As shown in FIGS. 3 and 4, the second rain seal strip 60 is applied to backing sheet 52 in a location upward of first rain seal strip 58—that is, in the direction of longitudinal edge 65 of top sheet 54. A seal down strip 72 is applied in intermittent patches or a continuous bead on the weather-facing surface of top sheet 54, across the length of top sheet 54 (FIG. 4). The function of seal down strip 72 is to adhere overlying courses of shingles to the adjacent underlying course. Seal down strip 72 is preferably applied to the weather facing surface of top sheet 54 in a location that is approximately coextensive with first rain seal strip 58, although the seal down strip can be applied in other positions. As noted below, however, seal down strip 72 is not exposed to the weather when the shingles are applied to a roof.

As stated, laminated shingles must be nailed through a double-layered section of the shingle. The nail zone in shingle 50 is much wider than the nail zone in the shingle shown in FIG. 1. In addition, the nail zone in shingle 50 is further removed from the headlap margin in the shingle. In shingle 50 the nail zone is that area extending along the length of the shingle and lying between a line extending roughly down the middle of rain seal strip 58 and the upper marginal edge 70 of backing sheet 52. Referring to FIG. 1 it may be seen that the lowermost margin of the nail zone (i.e., the margin nearest the lower marginal edge of the shingle, edges 64, 66) is not coextensive with headlap margin 69. Instead, the lower marginal edge of the nail zone has been moved upwardly away from the headlap margin. When a roofer applies the shingles to a roof deck the location of the upper marginal edge 70 of backing sheet 52 will not be readily apparent, at least not across the entire length of the shingle. This is because upper marginal edge 70 is hidden behind top sheet 54. Therefore, so that the nail zone is readily identifiable by a roofer, a narrow strip of paint is typically applied to the weather-facing surface of top sheet 54 coextensive with upper marginal edge 70 of backing sheet 54. The paint strip is not shown in FIG. 4 but would run longitudinally across the weather facing side of shingle 50 coextensively with upper marginal edge 70 of backing sheet 54.

The nail zone of shingle 50 is labeled with dimension Z' in FIG. 4. Since dimension Y' is always greater than ½ dimension X', the width of nail zone Z' is relatively much greater than the width of the nail zone in the prior art shingles shown in FIGS. 1 and 2.

Figure 5:
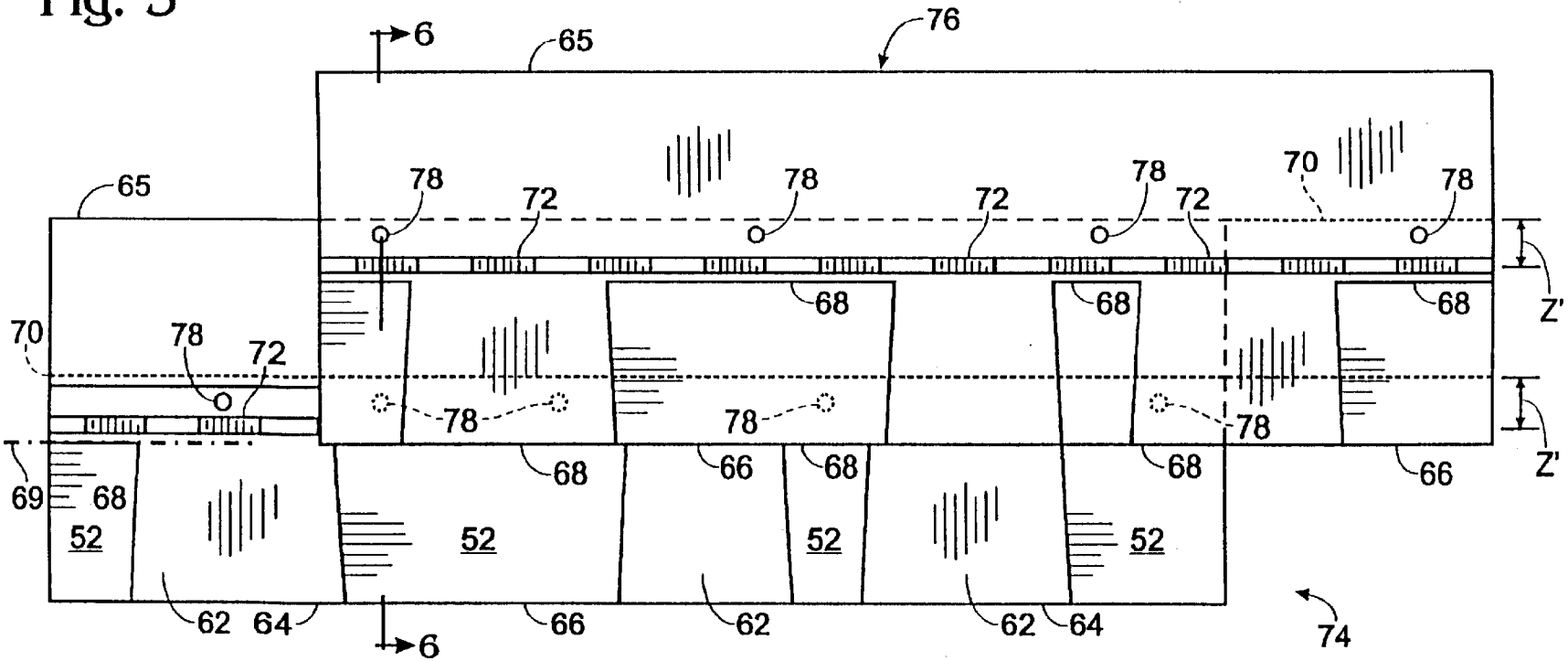
FIG. 5 is a top plan view of two laminated shingles as the shingles would be applied to a roof deck in two courses.

A pair of laminated shingles 74 and 76 is shown in FIG. 5 as they would be applied in two adjacent courses on a roof deck. Shingle 74 represents the first course and shingle 76 the second. The shingles are applied in staggered arrays in well-known manners. The second course of shingles is applied over the first course such that the lower marginal edge 66 of the backing sheet in shingle 76 is coextensive with the headlap margin (edge 68) of the top sheet of first shingle 74. First shingle 74 is applied to the roof deck with a plurality of nails 78 driven through the shingle in the nail zone Z'. Four of the five nails 78 shown in FIG. 5 through first shingle 74 are covered by the overlapping portion of second shingle 76, which also is applied to the roof deck with a plurality of nails 78.

Figure 6:
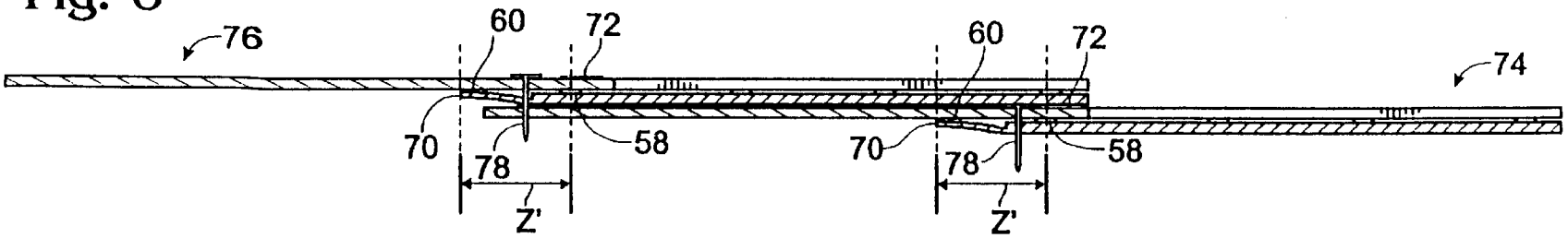
FIG. 6 is a cross sectional elevational view of the two shingles shown in FIG. 5, taken along the line 6—6 of FIG. 5.

FIG. 6 shows a sectional view along line 6—6 of FIG. 5, and illustrates the application of two courses of shingles to a roof deck (not shown). Nails 78 are driven through the nail zones Z' in each shingle, and as described above, it may be seen that nail zone Z' is substantially wider than the prior art nail zones. The lowermost edge of the nail zone is also positioned upwardly from the headlap margin. This allows the roofer far more leeway in the positioning of nails, which allows for more rapid nailing with pneumatic nail guns or staplers, and makes for far fewer misdriven nails. Since the function of the rain seal strips is to prevent water from travelling between the two layers of a laminated shingle, it is obviously preferable for the strip to be unbroken along its length, and also undisturbed by nails. The relatively narrow nail zone of prior art shingle 10 almost necessitates that nails be driven through the rain seal strip if the nails are to be properly placed. However, while the lowermost edge of the nail zone of shingle 50 runs through approximately the mid point of the first rain seal strip, in most instances, given the width of the nail zone of the present shingle, the roofer will drive the nails well above the first rain seal strip.

The laminated shingle of the present invention has a wider nail zone because the backing sheet is relatively wider than standard backing sheets in proportion to the overall width dimension of the shingle, that is, the width of the top sheet at its widest point. In fact, the length and width dimensions of the laminated shingle according to the present invention are, except for the extended width of the backing sheet, identical to standard products on the market. Nonetheless, use of a wider backing sheet requires a different roll stock to make the shingles.

Laminated shingles are manufactured from standard roll stock roofing materials that are well known in the art. Briefly described, this raw roll stock material is manufactured in continuous rolls beginning with a fibrous mat such as a glass fiber mat. As is common in the industry, the mat has a standard width, which ultimately results in laminated shingles having a standard width. Both the upper and lower surfaces of the mat are coated and impregnated with an asphaltic compound. Granular materials are then pressed into the weather-facing surface of the asphalt-impregnated sheet while the asphalt is pliable and tacky. To prevent sticking, sand or a similar material is dusted onto the opposite surface of the asphalt-impregnated sheet. The finished raw shingle material is accumulated in rolls. In standard roll stock roofing material, the sheet is consistent from side to side. In other words, all materials that are applied to the sheet are applied in equal amounts across the entire width of the sheet.

Figure 7:
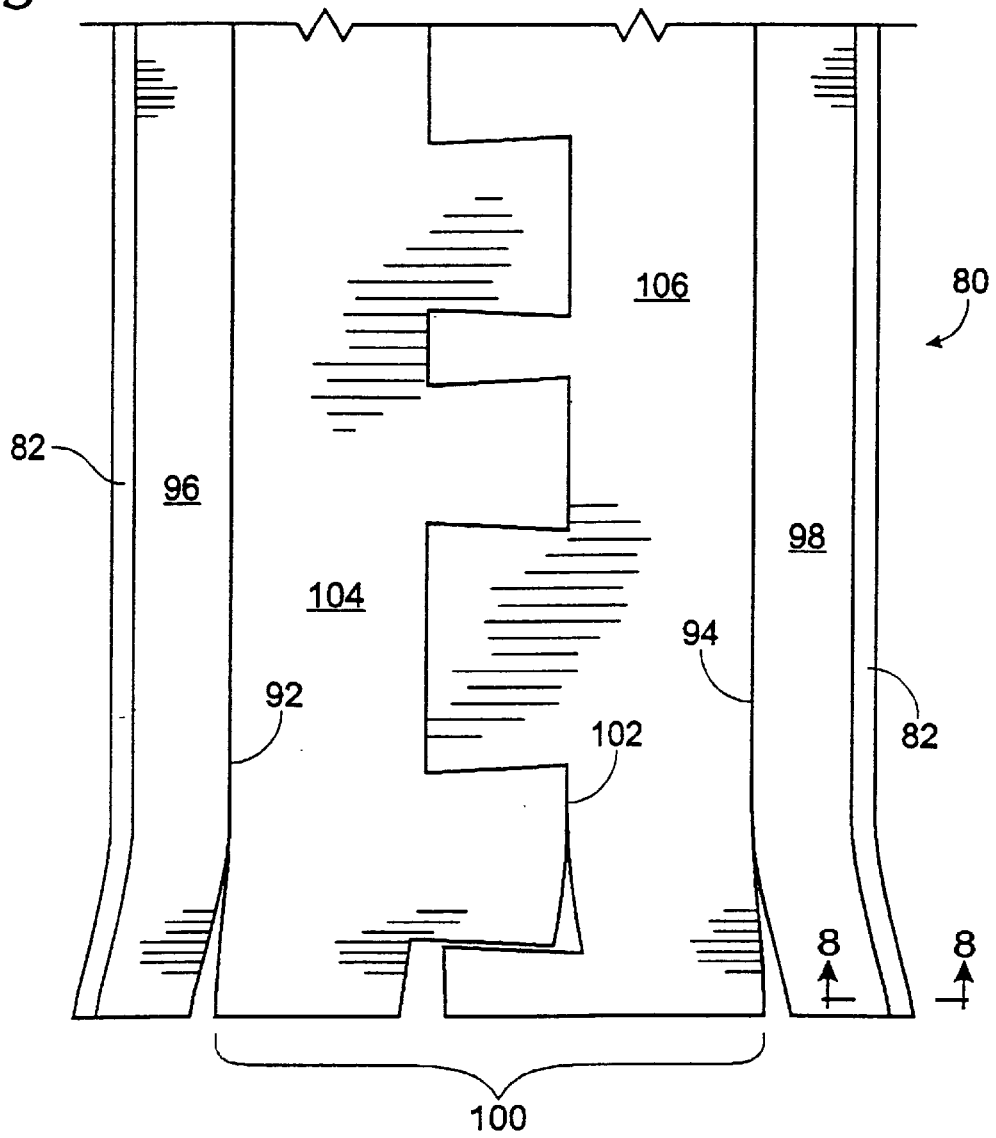
FIG. 7 is a top plan view of a section of the roll stock used to manufacture the laminated shingles of the present invention, illustrating the manner in which the roll stock is cut to make the laminates.

Referring to FIG. 7, the roll stock roofing material, sheet 80, used to make the laminated shingle of the present invention starts with a wider mat material. In the manufacturing process an edge strip 82 is fabricated into each outside edge of sheet 80. As detailed below, sheet 80 in the edge strips is relatively less thick than the remainder of the sheet.

Figure 8:
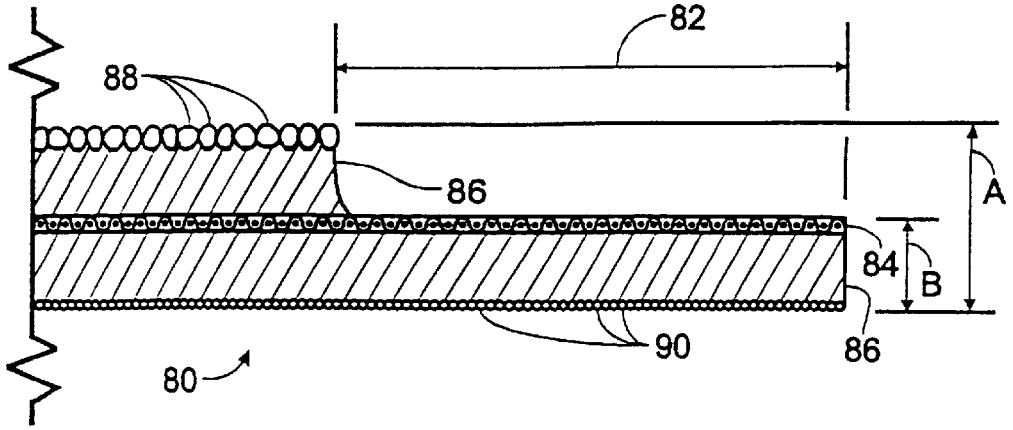
FIG. 8 is a close up, sectional end view of one side edge of the roll stock shown in FIG. 7.

Referring now to FIG. 8, sheet 80 comprises a central fibrous mat 84 onto which an asphalt material 86 has been laid over both surfaces of the mat. Asphalt 86 is applied hot and impregnates fibrous mat 84. The manner of asphalt application is well known in the art and does not form a part of this invention. To prevent sticking, a sand or sand-like material 90 is applied in a layer to one asphalt-coated surface as shown in FIG. 8. While the asphalt in the sheet is still hot the sheet is ran past a pair of scraper blades oriented on the side of the sheet opposite the sand-coated side, and positioned such that the blades scrape the asphalt 86 away from the sheet along the opposite outer edges of the sheet and down to the level of fibrous mat 84, producing edge strips 82. In order to prevent granular material from sticking to the just-scraped outer edges of the sheet, and depending upon the tackiness of the fibrous mat after scraping, sand material 90 may optionally be applied over the scraped outer edges. The thickness of edge strips 82, represented by dimension B, is less than thickness of the remainder of sheet 80, which in FIG. 8 is represented by dimension A. Typically, dimension B is approximately ½ A. The next step is the process of fabricating sheet 80 is to apply granular material 88 to the asphalt-coated surface opposite the sand-coated surface, while the asphalt is still tacky. The granules are pressed into the hot asphalt and are at least partially embedded therein. This granule-coated surface will eventually be the weather-facing surface of the shingles.

The sheet 80 is generally immediately used as the raw material for laminated shingles. The sheet is wider than roll stock used to make a similar laminated shingles. The added width in sheet 80 is accounted for in the two outer edge strips 82.

Returning to FIG. 7, sheet 80 is ran past blades that cut an outer strip from each outside edge of sheet 80 along cut lines 92 and 94, producing strips 96 and 98. These strips, each of which has the relatively thinner edge strip 82 extending along one longitudinal edge, will eventually become the backing sheets 14 of laminated shingles.

The central strip 100 remaining after strips 96 and 98 have been cut away from sheet 80 is of industry standard width for producing the top sheets of laminated shingles. This central strip is cut along line 102 by a rotating drum blade into two strips of material 104, 106, each of which has a tabbed pattern cut into one longitudinal edge. Each strip 104 and 106 has a uniform thickness of dimension A (FIG. 8) throughout the width of the strip. Strips 104 and 106 are used as the raw material for top sheets 54 of laminated shingles.

With sheet 80 cut into strips 96 and 98, and tabbed strips 104, 106, the strips are shifted along their longitudinal axes and aligned for lamination. The methods of laminating the strips are known in the art and form no part of the present invention. However, returning again to FIG. 3, it may be seen that the rain seal strips 58 and 60 are laid down on the backing sheet prior to the sheets being laminated. More particularly, rain seal strip 58 is located near the upper marginal edge 70 of backing sheet 52 above the headlap margin defined by the upper margins 68 of the cutout portions, but is not in the relatively narrower edge strip 82 of the backing sheet. The second rain seal strip 60 on the other hand is laid down on the backing sheet in the narrower edge strip 82 immediately adjacent the upper marginal edge 70 of backing sheet 52. Prior to lamination, asphalt-based adhesive is also applied to the non-weather facing surface of tabs 62 (i.e., the non-granule-coated surfaces).

The strips, with adhesive and rain seal strips applied as described above, are then pressed together between press rolls to join the strips. A release strip 108 is applied to the joined strips in a manner described below, and the continuous laminated strips are cut into appropriate lengths for shingles. Referring again to FIG. 3, that portion of the backing sheet 52 that extends beyond center point 55 of shingle 50 in the direction toward the upper marginal edge of the shingle (i.e., toward edge 65) is the relatively narrower edge strip 82.

Figure 9:
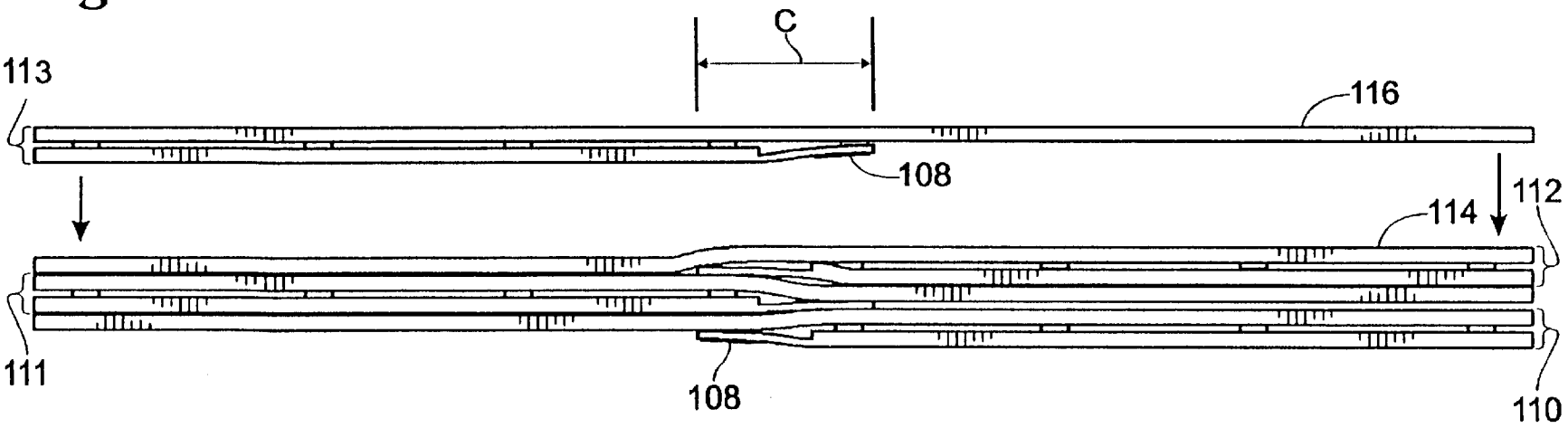
FIG. 9 is a side edge elevational view of two paired, stacked laminated shingles of the present invention

The cut shingles are then stacked and bundled. Four laminated shingles 110, 111, 112 and 113 are shown in FIG. 9. As noted, a release strip 108 is applied to the shingles. The release strip 108 is a longitudinally aligned strip of material located in a position such that when the shingles are stacked the seal down strip on one shingle is entirely covered by the release strip on the next adjacent shingle. The release strip is typically a plastic material and is a known method of preventing the adjacent shingles from sealing together during storage. In this case release strip 108 is applied to the non-weather facing side of the shingles adjacent the upper marginal edge 70 of the backing sheets.

For bundling, every other shingle in a stack is rotated 180° about the axis perpendicular to the longitudinal axis extending through the shingle. The thus rotated shingle is stacked atop an underlying adjacent shingle. It should be noted that when the shingles are stacked, the weather-facing surfaces of the shingles are oriented in the same manner. Stated otherwise, the granule-coated surface 114 of shingle 112 is facing the same way as the granule-coated surface 116 of shingle 113. This process of orienting and stacking paired shingles in opposite directions is continued until a stack of the desired number of shingles is formed. The stack is then overwrapped into a bundle. It will be appreciated that there are other shingle-shingle orientations in which the shingles of the present invention may be stacked, yet while maintaining a flat, stable stack.

A stack of shingles of the present invention, as shown in FIG. 9 where only two shingles are shown, will have a central zone C extending longitudinally down the stack in which the backing sheet on one shingle overlaps with the backing sheet on the adjacent shingle or shingles. This results in a stack that has more layers in this central zone than in the other portions of the stack. As can be seen, the stack of four shingles in FIG. 9 has eight distinct layers of shingle material in the zone C. All other areas of the stacked shingles, however, have only 6 layers. However, any tendency for the stack to bow is minimized because edge strip 82, which is about ½ as thick as the rest of the backing sheet (FIG. 8), lies in zone C when the shingles are stacked. In other words, while zone C has more layers of roofing material than other areas of the stack, the total thickness of the stack in zone C is roughly equal to the total thickness of the stack at any other point in the stack. This is because every other layer in zone C is accounted for by an edge strips 82, which as noted is about ½ the thickness of the rest of the sheets.

Shingles manufactured according to the present invention are quickly and easily applied to a roof deck. First, since the shingles are oriented in bundles with the weather-facing surfaces all facing in one direction, there is no need for the roofer to manipulate the shingle other than orienting every other shingle to the proper position (by rotating it 180° about the axis perpendicular to its longitudinal axis). Second, since the nail zone is substantially wider than prior art laminated shingles, the roofer can quickly drive nails through the shingle without misdriven nails.

As described above, is wider than standard roll stock used to make similar laminated shingles. The additional width of sheet 80 is equally divided between the two outer edge strips 82 of the portion of sheet 80 that becomes the backing sheets. When the backing sheet is laminated to a top sheet with the "lower" edges aligned, the backing sheet therefore extends further up the non-weather facing side of the top sheet in the width dimension by this increased amount. This added width of the backing sheet thus accounts for the added width of the nail zone.

In addition, the paired rain seal strips add an extra measure of protection to prevent water from being wicked or blown between the laminated sheets. With a single rain seal strip there is always a possibility that there is a break in the strip. This could lead to leakage through either a nail hole, or by water going over the upper marginal edge of the backing sheet. The second rain seal strip eliminates this latter possibility.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. A laminated roofing shingle, comprising:

a top sheet having first and second longitudinal marginal edges and alternating tabs and cutout portions along the first longitudinal marginal edge, a backing sheet having first and second longitudinal marginal edges and adhered to the top sheet with the first longitudinal marginal edge of the backing sheet in alignment with the first longitudinal marginal edge of the top sheet, the width of the backing sheet greater than ½ the width of the top sheet but less than the width of the top sheet, and the backing sheet having a first longitudinal section with a first thickness and a second longitudinal section with a second thickness, wherein the second thickness is less than the first thickness, and wherein the second longitudinal section extends along the second longitudinal marginal edge of the backing sheet.

2. The laminated roofing shingle of claim 1 in which that portion of the backing sheet that extends beyond ½ of the width of the top sheet in the direction toward the second longitudinal marginal edge of the top sheet is the second longitudinal section.

3. The laminated roofing shingle of claim 1 wherein the cutout portions of the top sheet define a longitudinal headlap margin, and wherein the shingle includes first and second continuous strips of asphalt between the first sheet and the second sheet, each of said strips positioned beyond the headlap margin in the direction toward the second longitudinal edges of the top and backing sheets.

4. The laminated roofing shingle of claim 3 in which the first continuous strip of asphalt is between the top and backing sheets and extends along the length of the first longitudinal section of the backing sheet.

5. The laminated roofing shingle of claim 3 in which the second continuous strip of asphalt is between the top and backing sheets and extends along the length of the second longitudinal section of the backing sheet.

6. The laminated roofing shingle of claim 1 in which the backing sheet and the top sheet each have a first weather-facing surface with granules embedded therein and a second surface opposite said first weather-facing surface, and wherein the first surface of the backing sheet is laminated to the second surface of the top sheet.

7. In an essentially rectangular two-layer laminated roofing shingle having a top sheet with first and second longitudinal marginal edges with alternating tabs and cutout portions along the first longitudinal marginal edge, the cutout portions defining a longitudinal headlap margin, and a backing sheet that is narrower than the top sheet and having a first and second longitudinal marginal edge, the backing sheet laminated to the top sheet with the first longitudinal marginal edge of the backing sheet aligned with the first longitudinal marginal edge of the top sheet, the improvement comprising:

the backing sheet extending beyond the headlap margin in the direction toward the second longitudinal marginal edge of the top sheet and more than ½ the width of the top sheet to define a nail zone between the headlap margin and the second longitudinal marginal edge of the backing sheet, said nail zone comprising a first and second contiguous layer of asphalt coated sheet extending longitudinally along the length of the shingle, the backing sheet including a first longitudinal section having a first thickness and a second longitudinal section having a second thickness that is less thick than the first thickness.

8. The laminated roofing shingle of claim 7 in which the first contiguous layer of asphalt coated sheet is the top sheet and the second contiguous layer of asphalt coated sheet is the backing sheet.

9. The laminated roofing shingle of claim 8 in which a substantial portion of the second contiguous layer of asphalt coated sheet in the nail zone is the second longitudinal section of the backing sheet.

10. The laminated roofing shingle of claim 7 further including a first continuous strip of asphalt extending along the length of the shingle between the top sheet and the backing sheet, and located between the headlap margin and the second longitudinal marginal edge of the backing sheet.

11. The laminated roofing shingle of claim 10 further including a second continuous strip of asphalt extending along the length of the shingle between the top sheet and the backing sheets, and located between the first continuous strip of asphalt and the second longitudinal marginal edge of the backing sheet.

12. The laminated roofing shingle of claim 9 in which the portion of the backing sheet that extends beyond the longitudinal centerline of the top sheet is the second longitudinal section of the backing sheet.

13. A method of manufacturing a laminated roofing shingle, comprising the steps of:

(a) providing a fibrous roofing mat having a first and second surfaces;

(b) coating both surfaces of the mat across the entire width thereof with an asphaltic compound to produce a composite sheet;

(c) removing the asphalt from an outer edge portion of each opposite edge of the first surface to produce an outer edge strip on each opposite edge of said first surface so that the sheet is thinner in said outer edge strips than the rest of the sheet;

(d) depositing on the first surface of the sheet a granular roofing material;

(e) cutting a continuous strip from each outer edge of the sheet to produce a pair of backing strips and a center strip, each backing strip having a first outer edge having a first outer edge strip that is less thick than the rest of the backing strip and a second outer edge;

(f) cutting the center strip into two tabbed strips, each having one first outer edge with alternating tabs and cutout portions;

(g) shifting said strips along the longitudinal axes thereof to align a backing strip with a tabbed strip such that an outer edge of a backing strip aligns with a first outer edge of a tabbed strip;

(h) applying adhesive to those portions of the tabbed strip that mate with the backing strip and laminating said aligned strips and cutting the strips into shingles of selected lengths.

14. The method of claim 13 in which step (g) includes the step of aligning the backing strip with a tabbed strip such that the second outer edge of the backing strip aligns with the first outer edge of the tabbed strip.

15. The method of claim 13 in which the backing strips are sized such that the width of said strips is greater than ½ the width of said tabbed strips at the widest point of said tabbed strips.

16. The method of claim 13 including the step of applying a first and second continuous strip of asphaltic sealing material to the backing strip prior to laminating said backing strip and said tabbed strip.

17. A laminated shingle manufactured according to the method of claim 13.

18. A method of manufacturing a laminated roofing shingle, comprising the steps of:

(a) producing a sheet of roofing material comprising a fibrous mat having a first surface coated with an asphaltic compound and having embedded therein granules, said first surface including outer edge strip portions that are not coated with asphalt or granules, a second surface of said sheet coated with an asphaltic compound over substantially the entire surface thereof, said sheet having a first thickness at such outer edge strip portions and a second thickness at all other portions, said first thickness being thinner than said second thickness;

(b) cutting a continuous strip from each outer edge of the sheet to produce a pair of backing strips and a center strip, each backing strip having a first outer edge comprising said outer edge strip portions, and a second outer edge opposite said first outer edge;

(c) cutting the center strip into two tabbed strips, each having one first outer edge with alternating tabs and cutout portions;

(d) aligning a backing strip with a tabbed strip such that the second outer edge of the backing strip aligns with the first outer edge of a tabbed strip;

(e) applying adhesive to a selected portion of the strips and laminating the strips together and cutting said laminated strips into shingles of selected lengths.

19. The method of claim 18 in which the backing strips are sized such that the width of said strips is greater than ½ the width of said tabbed strips at the widest point of said tabbed strips.

20. The method of claim 18 including the step of applying a first and second continuous strip of asphaltic sealing material to the backing strip prior to laminating said backing strip and said tabbed strip.

21. A laminated shingle manufactured according to the method of claim 18.

22. A laminated roofing shingle, comprising:

a top sheet having first and second longitudinal marginal edges and alternating tabs and cutout portions along the first longitudinal marginal edge, a backing sheet having first and second longitudinal marginal edges and adhered to the top sheet with the first longitudinal marginal edge of the backing sheet in alignment with the first longitudinal marginal edge of the top sheet, the backing sheet having a first longitudinal section with a first thickness and a second longitudinal section with a second thickness, wherein the second thickness is less than the first thickness and the second longitudinal section extends along the second longitudinal marginal edge of the backing sheet.

23. The laminated roofing shingle of claim 22 in which the width of the backing sheet is greater than ½ the width of the top sheet but less than the width of the top sheet.

24. The laminated roofing shingle of claim 23 in which the portion of the backing sheet that extends beyond ½ the width of the top sheet in the direction toward the second longitudinal marginal edge of the top sheet is the second longitudinal section.

25. The laminated roofing shingle of claim 22 in which the cutout portions of the top sheet define a headlap margin, and wherein the shingle includes first and second continuous strips of asphalt between the first sheet and the second sheet, each of said strips located beyond the headlap margin in the direction toward the second longitudinal edges of the top and backing sheets.

* * * * *